US005467499A

United States Patent [19]

Blouin

[11] Patent Number: 5,467,499

[45] Date of Patent: Nov. 21, 1995

[54] METHOD OF CLEANING AN INTERIOR CAVITY OF A CONTAINER AND A SCRAPPER

[76] Inventor: Bernadette D. Blouin, R.R. #1, Range Road 263, St. Albert, Alberta, Canada

[21] Appl. No.: 213,580

[22] Filed: Mar. 16, 1994

[51] Int. Cl.[6] ..... A47L 17/06

[52] U.S. Cl. ..... 15/236.05; 15/236.01

[58] Field of Search ..... 15/235.4, 235.7, 15/236.01, 236.02, 236.05, 236.06, 236.09, 245, 245.1

[56] References Cited

U.S. PATENT DOCUMENTS

| | | | |
|---|---|---|---|
| 1,192,910 | 8/1916 | Lawrence | 15/236.05 |
| 1,388,282 | 8/1921 | Meredith | 15/245 |
| 1,498,155 | 6/1924 | Dorr | 15/245 |
| 1,898,690 | 2/1933 | Schacht | 15/245 |
| 2,280,225 | 4/1942 | Finely | 15/245 |
| 2,900,656 | 8/1959 | Tupper | 15/245 |
| 3,341,878 | 9/1967 | Hubbard | 15/235.4 |
| 3,408,677 | 11/1968 | Yates | 15/236.02 |
| 3,676,888 | 7/1972 | Akers | 15/245 |
| 4,097,951 | 7/1978 | Hurtt | 15/245.1 |
| 4,121,316 | 10/1978 | Perry | 15/236.02 |
| 4,784,598 | 11/1988 | Kranz et al. | 15/245 |
| 5,099,540 | 3/1992 | Paschetto | 15/236.02 |
| 5,272,786 | 12/1993 | Edström | 15/236.01 |

FOREIGN PATENT DOCUMENTS

| | | | |
|---|---|---|---|
| 162184 | 4/1921 | United Kingdom | 15/236.05 |
| 896763 | 5/1962 | United Kingdom | 15/143.1 |

*Primary Examiner*—Mark Spisich
*Attorney, Agent, or Firm*—Anthony R. Lambert

[57] ABSTRACT

A method and apparatus for cleaning an interior cavity of a container including the following described steps. Firstly, insert a hard pliant card with rapid elastic recovery to within 96% of original into an interior cavity of a container. Secondly, exert a force upon the card until the card deforms to assume an arcuate shape substantially conforming with the interior contours of the container. Thirdly, move the card along the interior contour of the container in a scraping action such that an edge of the card scrapes residue from the interior contour of the container.

1 Claim, 5 Drawing Sheets

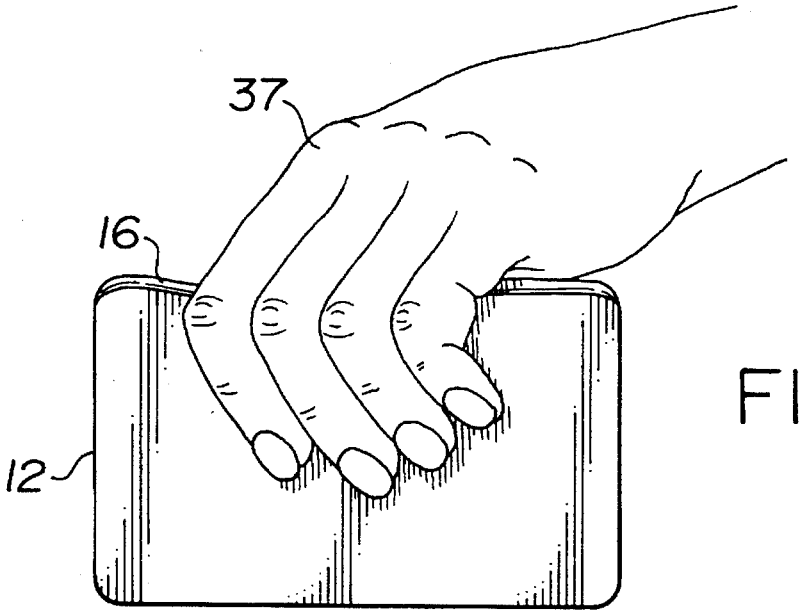
FIG. 5.
FIG. 6.
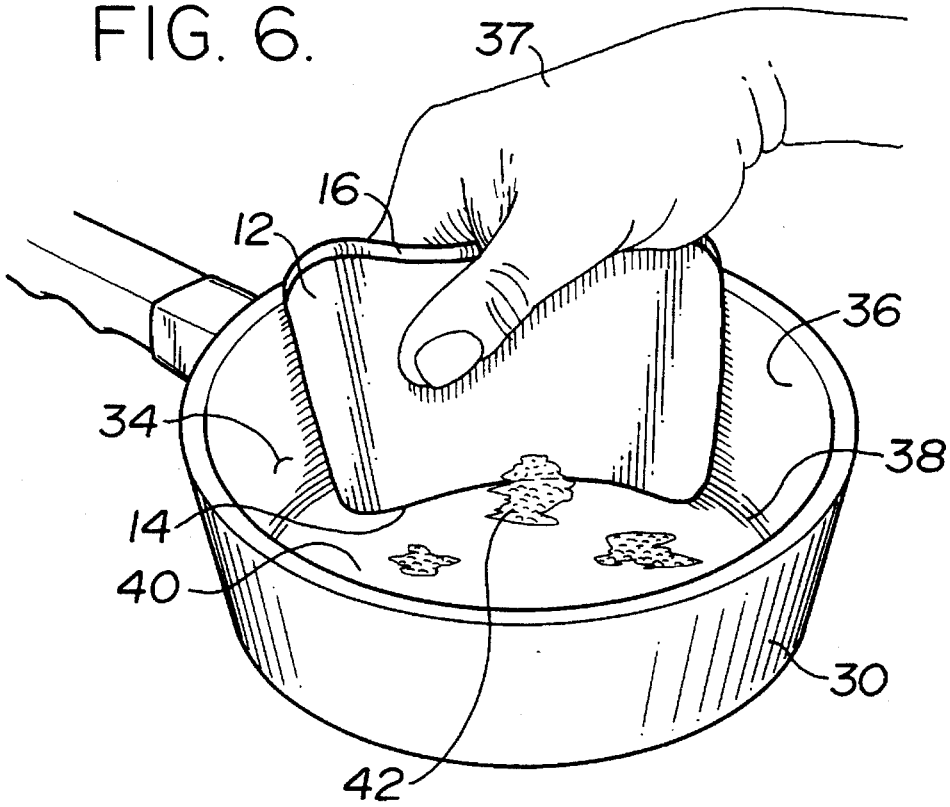

METHOD OF CLEANING AN INTERIOR CAVITY OF A CONTAINER AND A SCRAPPER

The present invention relates to a method of cleaning an interior cavity of a container and a scraper.

BACKGROUND OF THE INVENTION

A scraper is used to scrape residue from an interior cavity of containers such as a pots, pans, bowls, and the like. Two commonly used form of scrapers are rigid blades mounted on handles and abrasive pads. There are several locations on every pot that are particularly hard to clean. One location is a circumferential interior sidewall, especially those with tight radiused curves. Another location is a substantially 90 degree corner formed where the circumferential interior sidewall meets the bottom. Scrapers with rigid blades cannot reach these hard to clean areas. Abrasive pads can reach these areas with the application of pressure with one's fingers, but this tends to be hard on the user's hands.

SUMMARY OF THE INVENTION

What is required is a method of cleaning an interior cavity of a container which is better suited to clean areas such as circumferential interior sidewalls and substantially 90 degree corners formed where the circumferential interior sidewall meets the bottom of the container.

According to one aspect the present invention there is provided a method of cleaning an interior cavity of a container including the following described steps. Firstly, insert a hard pliant card with rapid elastic recovery to within 96% of original into an interior cavity of a container. Secondly, exert a force upon the card until the card deforms to assume an arcuate shape substantially conforming with the interior contours of the container. Thirdly, move the card along the interior contour of the container in a scraping action such that an edge of the card scrapes residue from the interior contour of the container.

With the method, as described above, the scraper conforms to the contours of the surface being cleaned. This provides a superior cleaning action. It is preferred that the card is made of a polymer plastic material. The described method is most useful with tightly radiused circumferential interior sidewalls, where the circumferential interior sidewall is an arcuate surface with between a 1 inch and 6 inch radiused curve. An example of such an application is a muffin pan. Regardless of the size of the pan, the method is also useful in cleaning a substantially 90 degree corner formed where the circumferential interior sidewall meets a bottom of the pan.

According to another aspect of the invention there is provided a scraper which includes a hard pliant card capable of assuming an arcuate shape to conform with an interior contour of a container with rapid elastic recovery to within 96% of it's original shape and having at least one edge adapted for scraping.

It is preferred that the card be made of a polymer plastic material. It is preferred that the card be substantially rectangular in shape, although some success has been obtained with other shapes.

Although beneficial results may be obtained through the use of the card, as described above, there are additional features that can be added for the convenience of the user. The card is more comfortable to grip when it has a gripping edge contoured with an arcuate indent, so that the gripping edge substantially conforms to the contours of the human hand. In addition the card can be provided with a beaded gripping edge which is easier and more comfortable to grip. The card will normally sink in water, so it is also advantageous if the beaded gripping edge is buoyant thereby enabling the card to float. There are some applications in which greater leverage is desirable. A removable handle can be provided for such applications. The handle has a gripping end and a card attachment end. The card attachment end has a key hole opening adapted to receive the beaded gripping edge of the card.

For best results it is preferred that the card is capable of assuming between a 1 inch and 6 inch radiused curve and conforming to a substantially 90 degree corner.

BRIEF DESCRIPTION OF THE DRAWINGS

These and other features of the invention will become more apparent from the following description in which reference is made to the appended drawings, wherein:

FIG. 5 is a side elevation view of the scraper illustrated in FIG. 1, showing the correct manner of gripping the scraper.

FIG. 6 is a perspective view of the scraper illustrated in FIG. 1 in use with a pot.

DETAILED DESCRIPTION OF THE PREFERRED EMBODIMENT

Figure 1:
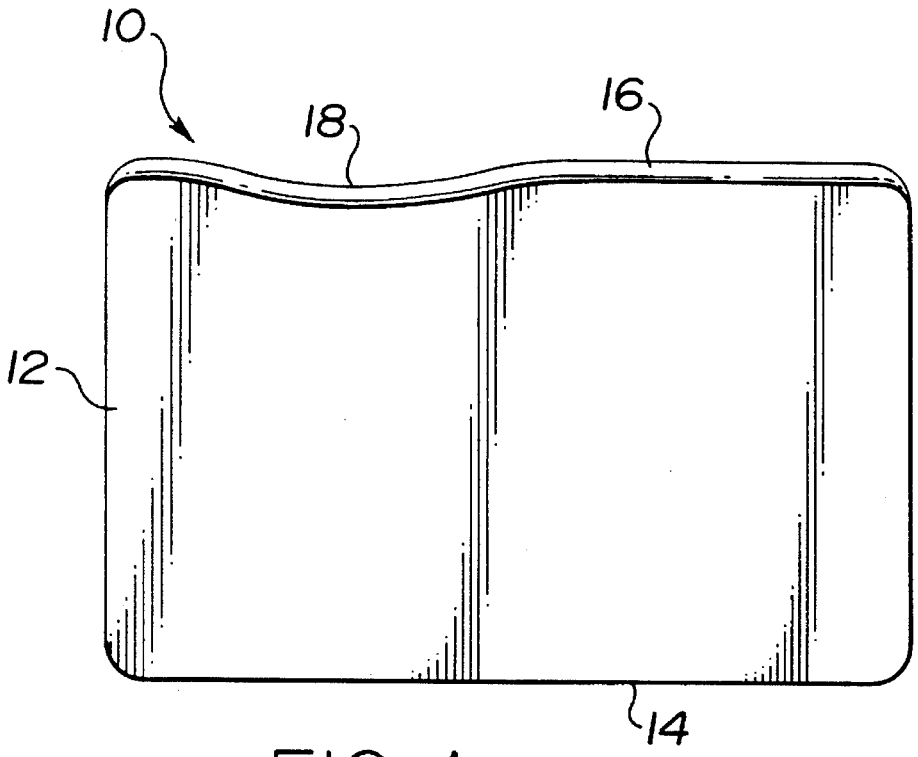
FIG. 1 is a side elevation view of a scraper manufactured in accordance with the teachings of the present invention.

The preferred embodiment, a scraper generally identified by reference numeral 10, will now be described with reference to FIGS. 1 through 8.

Figure 2:
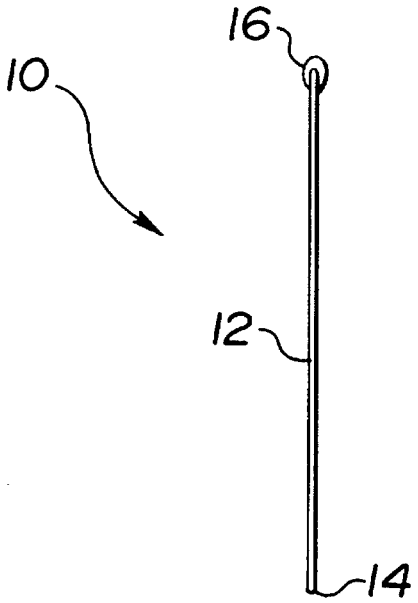
FIG. 2 is an end elevation view of the scraper illustrated in FIG. 1.
Figure 4:
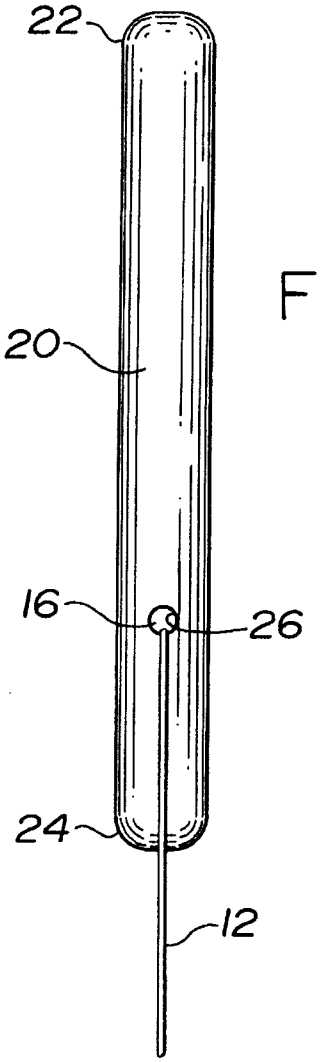
FIG. 4 is an end elevation view of the scraper illustrated in FIG. 3.
Figure 3:
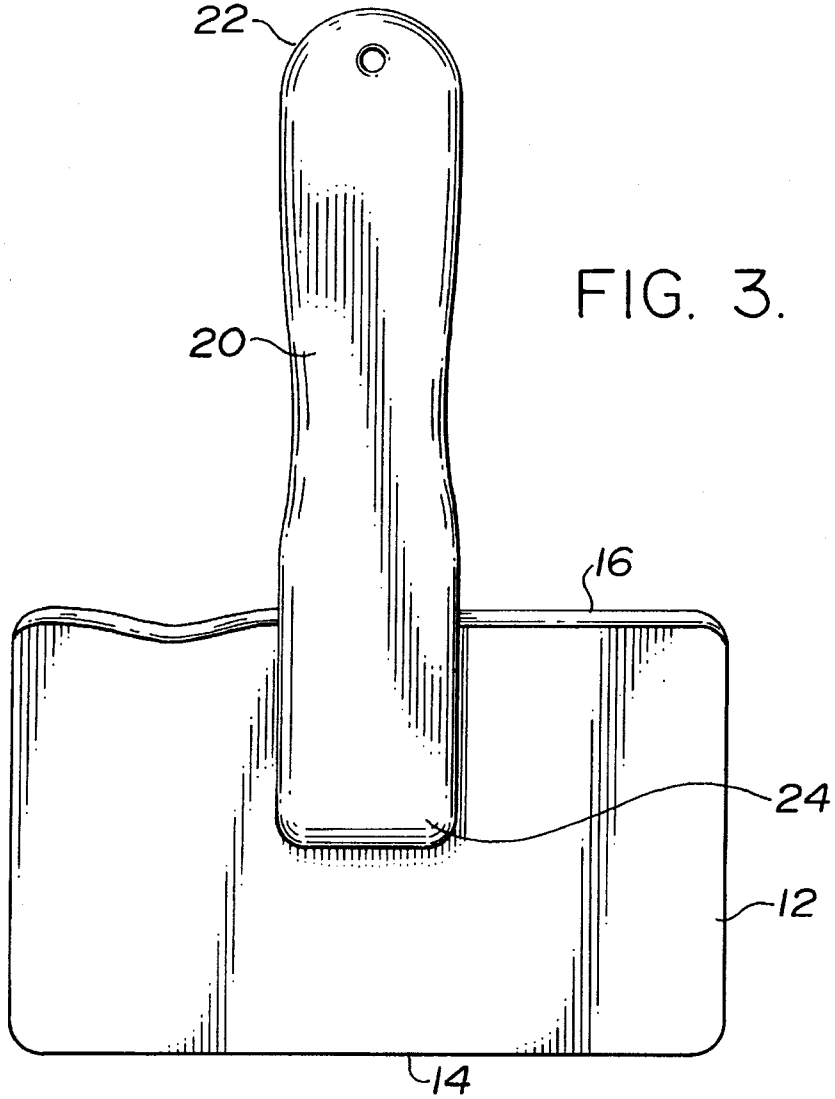
FIG. 3 is a front elevation view of the scraper illustrated in FIG. 1 with handle attachment.

Referring to FIG. 1, scraper 10 includes a hard pliant rectangular polymer plastic card 12. Polymer plastic card 12 must be hard in order to function as a scraper. The properties of polymer plastic card 12 are critical. It must be capable of assuming an arcuate shape to substantially conform with the interior contours within the interior cavity of a container, as will be hereinafter further described. It must have a rapid elastic recovery to within 96% of it's original shape. Polymer plastic card 12 has an edge 14 adapted for scraping. A gripping edge 16 contoured with an arcuate indent 18 is positioned opposite to scraping edge 14. Referring to FIG. 2, it is to be noted that gripping edge 16 is beaded. It is preferred that beaded gripping edge 16 be made buoyant either through choice of materials or by filling with a gas. Referring to FIGS. 3 and 4, a handle 20 is adapted to fit onto scraper 10 to provide additional leverage. Handle 20 has a gripping end 22 and a card attachment end 24. Card attachment end 24 has a key hole opening 26. Key hole opening 26 receives beaded gripping edge 16 of card portion 12 of scraper 10.

Figure 7:
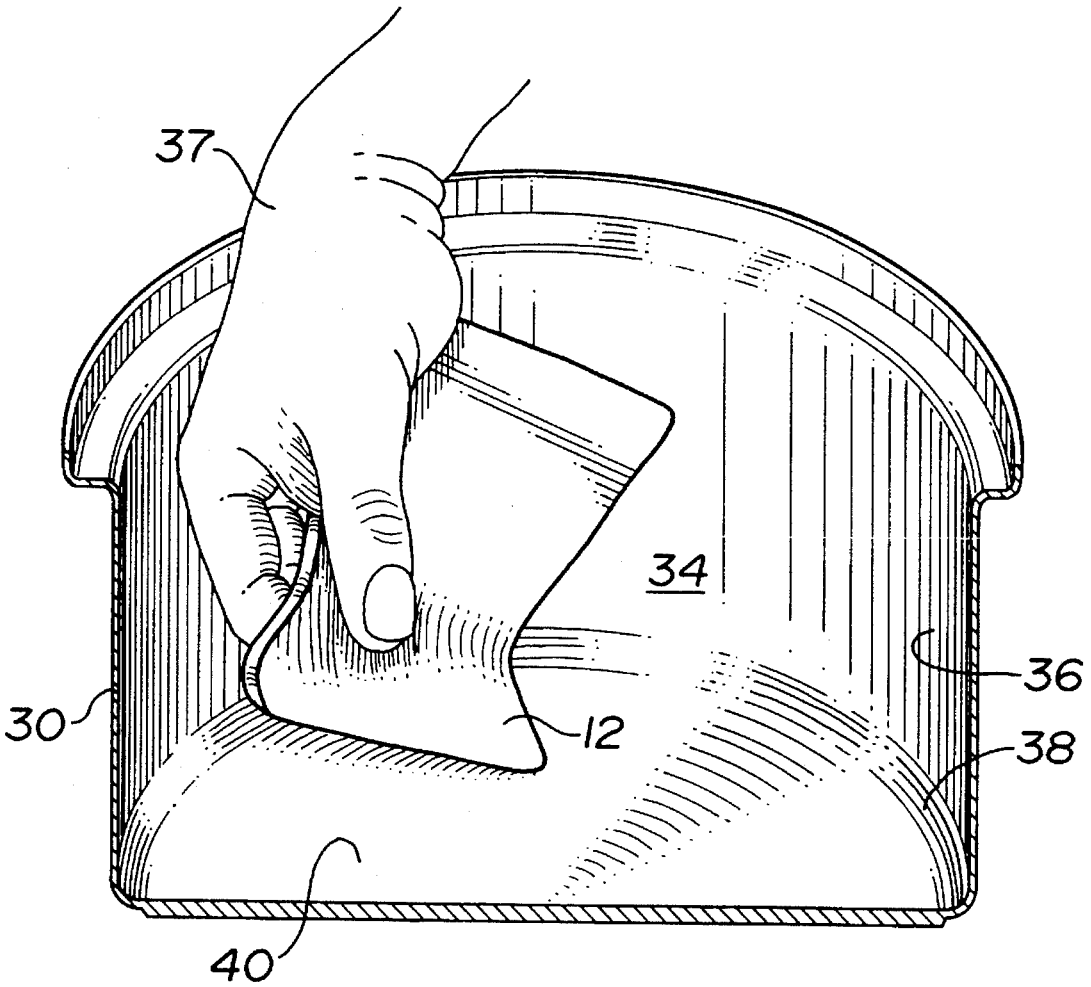
FIG. 7 is a side elevation view in section of the scraper illustrated in FIG. 1 in use with the pot illustrated in FIG. 6.
Figure 8:
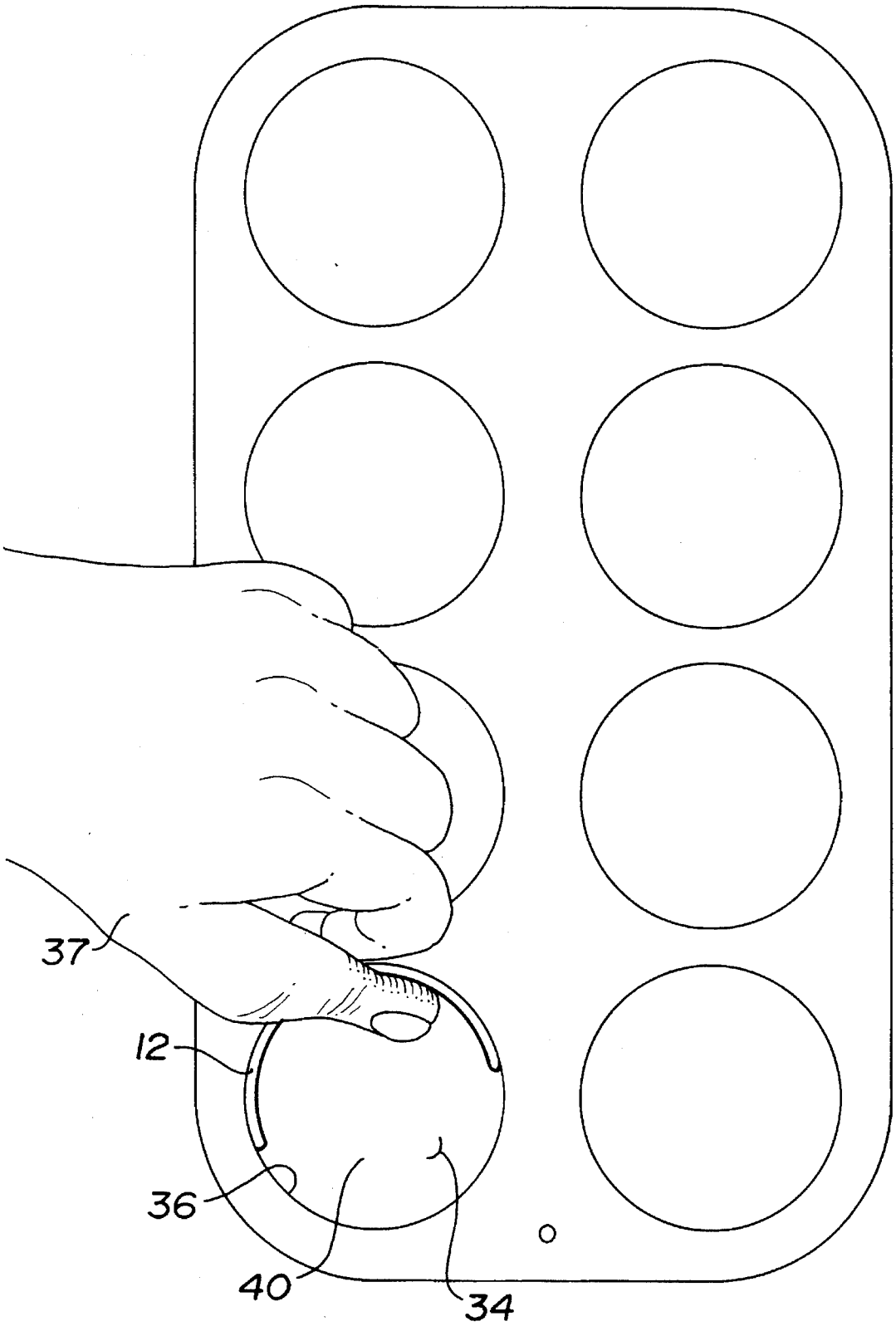
FIG. 8 is a top plan view of the scraper illustrated in FIG. 1 in use with a muffin tin.

The preferred method of use for apparatus 10 will now be described with reference to FIGS. 1 through 8. The environment in which scraper 10 is intended to be used will first be described. Referring to FIGS. 6 and 7, there is illustrated a pot 30. Referring to FIG. 8, there is illustrated a muffin tin 32. Although only pot 30 and muffin tin 32 are illustrated it will be understood that the described method is equally applicable to pans, deep dishes and the like. Referring to FIGS. 6 and 7, pot 30 has an interior cavity 34. Interior cavity 34 has an interior contour which includes a circumferential interior sidewall 36 and a substantially 90 degree corner 38 formed when circumferential interior sidewall 36 meets a bottom 40 of pot 30. Referring to FIG. 8, muffin tin 32 also has an interior cavity 34. Interior cavity 34 has an interior contour which also includes a circumferential interior sidewall 36 and a substantially 90 degree corner 38 formed when circumferential interior sidewall 36 meets a bottom 40 of muffin tin 32. FIG. 5 illustrates how gripping edge 16 contoured to place the hand 37 of the user in a comfortable position. The fact that gripping edge 16 is beaded providing some comfort for the hand of the user when pressure is applied.

The method consists of the following steps. Firstly, scraper 10 is inserted into interior cavity 34 of pot 30, as illustrated in FIG. 6. Secondly, a force is exerted upon card 12 until card 12 deforms to assume an arcuate shape that conforms with one of the interior contours of pot 30. Referring to FIG. 6, card 12 is illustrated conforming with circumferential interior sidewall 36. Referring to FIG. 7, card 12 is illustrated conforming to corner 38. Thirdly, card 12 is moved circumferential interior sidewall 36 or along corner 38 where circumferential interior sidewall 36 meets bottom 40 in a scraping action. When this is done scraping edge 14 of card 12 scrapes food residue 42 from pot 30.

The key to scraper 10 is its flexibility. Scrapers used in the past were unable to conform to a 90 degree corner 38 as illustrated in FIG. 7. Similarly, scraper used in the past were unable to conform with a 1 inch radiused curve of muffin tin 32, as illustrated in FIG. 8.

Some additional features can be added to scraper 10 for the convenience of the user. Where greater leverage is desirable beaded gripping edge 16 of card 12 can be slid into key hole opening 26 of handle 20 to attach handle 20 as illustrated in FIGS. 3 and 4. Card 12 does not normally float. It can be more convenient if beaded gripping edge 16 is adapted to make card 12 buoyant.

Scraper 10 is quick and easy to use regardless of whether the use is right or left handed. It does not damage the finish of the pot, pan or dish; although it is recommended that the pot, pan or dish be left soaking in dish water to soften food residue 42 prior to scraping, as opposed to scraping when food residue 42 has dried. It takes little storage space and is easy to clean. It is used on hard to reach surfaces where persons previously had to use either abrasive pads or their fingernails.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A scraper, comprising:

a hard pliant rectangular card with three scraping edges and a beaded gripping edge having axial contouring on a plane coincident with the card thereby forming an arcuate indent, the card being of polymer plastic material sufficiently pliant to conform to a one inch radiused curve and to a substantially 90 degree corner with rapid elastic recovery to within 96% of its original shape.

* * * * *